US009121273B2

(12) United States Patent
Norrid

(10) Patent No.: US 9,121,273 B2
(45) Date of Patent: Sep. 1, 2015

(54) FLOW CONTROL SYSTEM

(71) Applicant: Schlumberger Technology Corporation, Sugar Land, TX (US)

(72) Inventor: William Norrid, Westminster, CO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 449 days.

(21) Appl. No.: 13/693,450

(22) Filed: Dec. 4, 2012

(65) Prior Publication Data

US 2014/0151054 A1 Jun. 5, 2014

(51) Int. Cl.
*E21B 43/12* (2006.01)
*E21B 43/26* (2006.01)
*E21B 34/14* (2006.01)

(52) U.S. Cl.
CPC ..... *E21B 43/26* (2013.01); *E21B 34/14* (2013.01)

(58) Field of Classification Search
CPC ..... E21B 43/26; E21B 43/267; E21B 33/13; E21B 33/146; E21B 2034/007; E21B 34/14
USPC ..... 166/194, 318, 332.4, 308.1, 177.5, 289
See application file for complete search history.

(56) References Cited

U.S. PATENT DOCUMENTS

| | | | | |
|---|---|---|---|---|
| 8,261,761 | B2 * | 9/2012 | Gerrard et al. | 137/1 |
| 8,291,988 | B2 * | 10/2012 | King | 166/387 |
| 2004/0118564 | A1 * | 6/2004 | Themig et al. | 166/305.1 |
| 2010/0212911 | A1 * | 8/2010 | Chen et al. | 166/373 |
| 2011/0108284 | A1 * | 5/2011 | Flores et al. | 166/373 |
| 2011/0180274 | A1 * | 7/2011 | Wang et al. | 166/386 |
| 2011/0253383 | A1 * | 10/2011 | Porter et al. | 166/373 |
| 2012/0205120 | A1 * | 8/2012 | Howell | 166/373 |
| 2013/0081817 | A1 * | 4/2013 | Norrid et al. | 166/305.1 |
| 2014/0246209 | A1 * | 9/2014 | Themig et al. | 166/374 |

* cited by examiner

*Primary Examiner* — Blake Michener
(74) *Attorney, Agent, or Firm* — David J. Groesbeck; Brandon S. Clark

(57) ABSTRACT

A system and methodology facilitate flow control through actuation of valves individually along a plurality of zones. The system and methodology may be used in a variety of applications, including fracturing operations in which the valves are selectively actuated to control flow of fracturing fluid to specific zones of a formation. In fracturing applications, a well string is provided with a plurality of stages positioned sequentially along a plurality of surrounding zones, e.g. well zones. Each stage may be uniquely actuated relative to other stages by dropping a ball or balls down to the desired stage and actuating the valve via application of pressure.

20 Claims, 7 Drawing Sheets

FLOW CONTROL SYSTEM

BACKGROUND

Hydrocarbon fluids such as oil and natural gas may be obtained from a variety of formations. In some applications, the formations are fractured to facilitate oil and/or gas flow. During fracturing operations, fracturing fluids are pumped downhole and injected into the surrounding formation under pressure to create cracks or fractures through the formation. The formation fractures increase the conductivity of the formation which enhances hydrocarbon fluid recovery by improving fluid flow from the formation to the wellbore or wellbores drilled into the formation.

SUMMARY

In general, the present disclosure provides a system and method of actuating valves individually along a plurality of zones. The system and methodology may be used in a variety of applications, including fracturing operations in which the valves are selectively actuated to control flow of fracturing fluid to specific zones of the formation. In fracturing applications, a well string is provided with a plurality of stages positioned sequentially along a plurality of corresponding zones, e.g. well zones. Each stage may be uniquely actuated relative to other stages by dropping a ball or balls down to the desired stage and actuating the valve via application of pressure.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
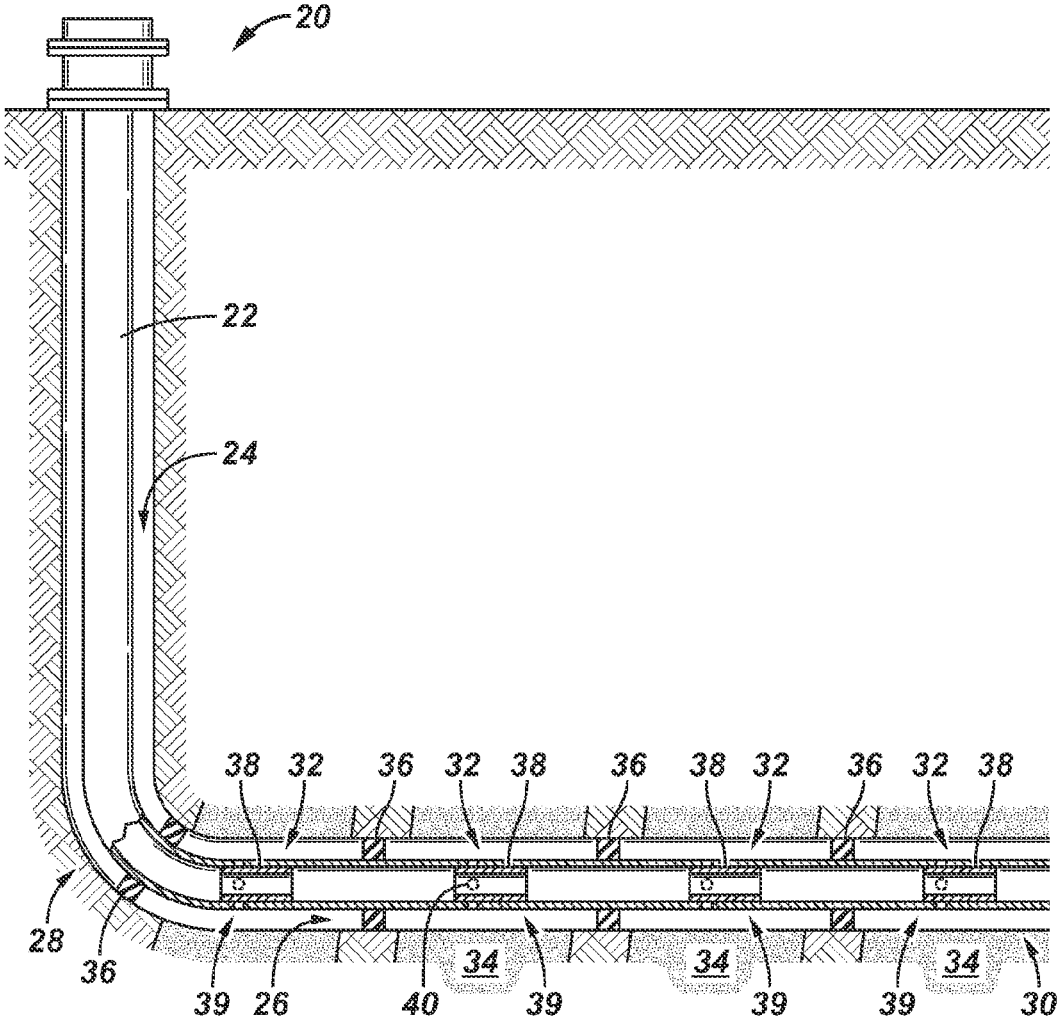
FIG. 1 is a schematic illustration of a well system having a well string with a plurality of fracturing stages deployed along a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology for actuating valves individually along a plurality of zones. The technique may be used in a variety of applications to control flow with respect to the plurality of zones. For example, the technique may be used in fracturing operations to selectively actuate valves which control flow of fracturing fluid to specific zones of the formation. In fracturing applications, a well string may be provided with a plurality of stages positioned sequentially along a plurality of corresponding zones, e.g. surrounding well zones. Each stage may be uniquely actuated relative to other stages by dropping a ball or balls down to the desired stage and actuating the valve via application of pressure.

In a specific example, the fracturing system comprises a well string having a plurality of fracturing stages positioned sequentially along a plurality of corresponding well zones. Each fracturing stage comprises a sleeve, e.g. a sliding sleeve, which may be moved by pressure applied against a dropped ball landed on a ball seat to operate a valve and thus expose an outlet port. Fracturing fluid may be injected through the outlet port and into a corresponding well zone. Each fracturing stage may comprise at least one ball seat and often a plurality of ball seats which are compressible between a radially expanded position and a radially contracted position within the sliding sleeve. Each ball seat may be transitioned to the radially contracted position by moving the ball seat into engagement with a restriction positioned within the sleeve. When a given ball seat is radially contracted by the restriction, the dropped ball is blocked from passage therethrough.

Each fracturing stage uses a unique number of ball seats to control the sequence of actuation, and thus the injection of fracturing fluid, relative to the other stages. When a ball is dropped, the ball engages the ball seat contracted by the restriction and moves the ball seat past the restriction. Once the ball seat moves past the restriction, the ball seat expands radially to allow the ball to move through the ball seat and on to the next stage. After passing through the restriction, the ball seats accumulate on the downstream side of the restriction within the sleeve until the accumulated ball seats prevent passage of the ultimate or last ball seat. Because the ultimate ball seat cannot pass through the restriction when contacted by a dropped ball, increased pressure causes the ball to shift the sleeve and open the valve/outlet port, thus allowing injection of fracturing fluid at that particular fracturing stage. The fracturing stages may be designed such that different numbers of ball seats pass through the restriction before being retained in the restriction to enable actuation of the valve at a particular stage. This allows the fracturing stages to be actuated according to a desired pattern, e.g. a sequential pattern moving from a toe to a heel of a deviated wellbore.

The fracturing stages and corresponding sleeves may be designed to provide a large number of fracturing stages which are all actuated by balls of the same diameter. By using the stacked ball seats, or other stackable members, the number of fracturing stages that can be actuated by the same size ball is substantially increased. The stackable members are progressively moved from one side of the restriction (e.g. a reduced inside diameter of the sleeve) to the other side of the restriction until there is no more room for the next stackable member/ball seat to pass the restriction. At this point, a ball is dropped to engage the radially contracted ball seat within the restriction so pressure may be applied to shift the sliding sleeve to an open flow position. The balls dropped to operate the plurality of stages in a given fracturing system may be made from a dissolvable material so that each ball may be dissolved after completion of the fracturing operation at a given fracturing stage.

Referring generally to FIG. 1, an embodiment of a flow control system, e.g. a flow control multi-stage fracturing system, is illustrated. By way of example, the flow control system may be used in a variety of fracturing applications and other applications in which it is useful to independently control flow at a plurality of stages. In a variety of fracturing applications, the well system may be used in deviated wellbores to facilitate sequential actuation of numerous individual fracturing stages via dropped balls having a common diameter. The specific components of the fracturing system or other type of flow control system may vary based on parameters related to the surrounding environment and the function of the overall system.

In the example illustrated in FIG. 1, a flow control system 20, e.g. a formation fracturing system, is illustrated as comprising a well string 22 deployed in a wellbore 24. Wellbore 24 may comprise a deviated, e.g. horizontal, wellbore section 26 which extends between a heel 28 and a toe 30 section of the well. Well string 22 comprises a plurality of flow control stages 32, e.g. fracturing stages, positioned sequentially along the well string 22 at corresponding well zones 34. In some applications, the well string 22 may comprise a plurality of packers 36 positioned between the fracturing stages 32. It should be noted the flow control stages 32 also may be utilized in vertical wellbores.

Depending on the flow control application, each flow control stage 32 may comprise a variety of components and features. For example, each flow control stage 32 may be in the form of a fracturing stage having a sleeve 38, e.g. a sliding sleeve, which is coupled to a valve 39 that may be actuated to control the outflow of fluid, e.g. outflow of fracturing fluid. By way of example, valve 39 may be in the form of sliding sleeve 38 working in cooperation with a port 40, such as an outlet port. However, port 40 may be selectively opened by a variety of other types of valves 39, and sleeve 38 may comprise a variety of connection members coupled to the valve for actuating the valve 39. As described in greater detail below, the sleeves 38 may be actuated by balls dropped down through well string 22 for engagement with a corresponding ball seat. Pressure may be applied along an interior of the well string 22 and against the ball and ball seat to shift the sleeve 38, thus allowing outflow of fluid, e.g. fracturing fluid, through the corresponding port 40. It should be noted that the term "ball" is used herein to generally represent dropped objects used to actuate the individual stages 32. Accordingly, the dropped balls may have a variety of shapes and configurations, including spherical shapes and other suitable shapes designed to engage corresponding ball seats. In some applications, the balls may be in the form of darts, cylinders with a hemispherical lead end, distorted spheres, and/or other suitable shapes and configurations.

Figure 2:
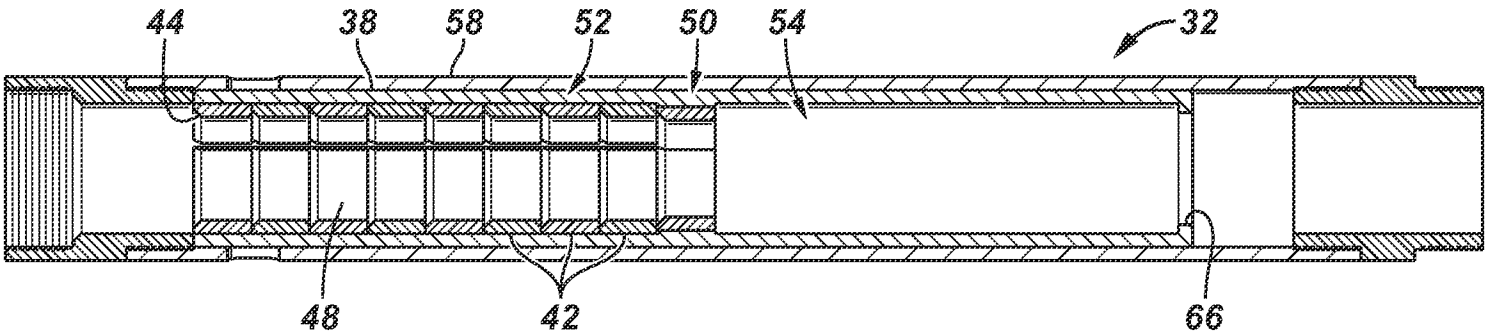
FIG. 2 is a cross-sectional view of an example of a flow control stage, e.g. a fracturing stage, that may be used with the well system illustrated in FIG. 1, according to an embodiment of the disclosure.

Referring generally to FIG. 2, an embodiment of stage 32 is illustrated in a form which may be employed in a fracturing operation. In this embodiment, the stage 32 comprises a plurality of individual stackable members 42 disposed within sliding sleeve 38. By way of example, the stackable members 42 may be in the form of ball seats each having a seat 44 for receiving a ball 46 (see FIG. 3). In this example, each ball seat 42 is radially compressible between a radially expanded position and a radially contracted position within the sliding sleeve 38. The radially contracted position blocks passage of ball 46 while the radially expanded position allows ball 46 to pass through an open interior 48 of the ball seat. It should be noted that when ball seats 42 are in the radially expanded state, the seat 44 of each ball seat 42 provides a seating profile but the profile is sufficiently large to allow the ball 46 to pass through the interior 48 of each expanded ball seat 42. However, when a given ball seat 42 is radially contracted the diameter of its interior 48 is reduced and the seating profile 44 becomes a seating surface which prevents passage of ball 46. Effectively, the ball 46 seats against seat 44 when the ball seat 42 is transitioned to its radially contracted state.

To facilitate the radial contraction, each stage 32 further comprises a restriction 50 which extends inwardly from the sliding sleeve 38. By way of example, restriction 50 may comprise a reduced diameter section of the sleeve 38. The stackable members 42, e.g. ball seats 42, initially are positioned in sliding sleeve 38 on a first side 52 of restriction 50, as best illustrated in FIG. 2. In many fracturing applications, the first side 52 of restriction 50 is a region within sleeve 38 on an upstream side of the restriction 50 relative to the downward flowing fracturing fluid. The stack of ball seats 42 on the first side 52 effectively moves the lead ball seat 42 into restriction 50 which radially compresses the ball seat to the radially contracted position which prevents passage of ball 46. Consequently, movement of ball 46 down through the stage 32 causes the ball 46 to seat against surface 44 of the particular ball seat 42 contracted within restriction 50. If there is nothing to block movement of the ball seat to a second side 54, e.g. a downstream side, of the restriction 50 within sleeve 38, pressure applied against ball 46 causes the ball seat 42 to move past the restriction 50 and into the interior of sliding sleeve 38 at the second side 54. It should be noted that the ball seats 42 may be continually moved into restriction 50 by the natural flow of fracturing fluid, by the resistance of the ball 46 moving through the interior of the ball seats 42, by a spring mechanism within the sliding sleeve 38, and/or by other suitable techniques which continually load the lead ball seat 42 into restriction 50.

Figure 3:
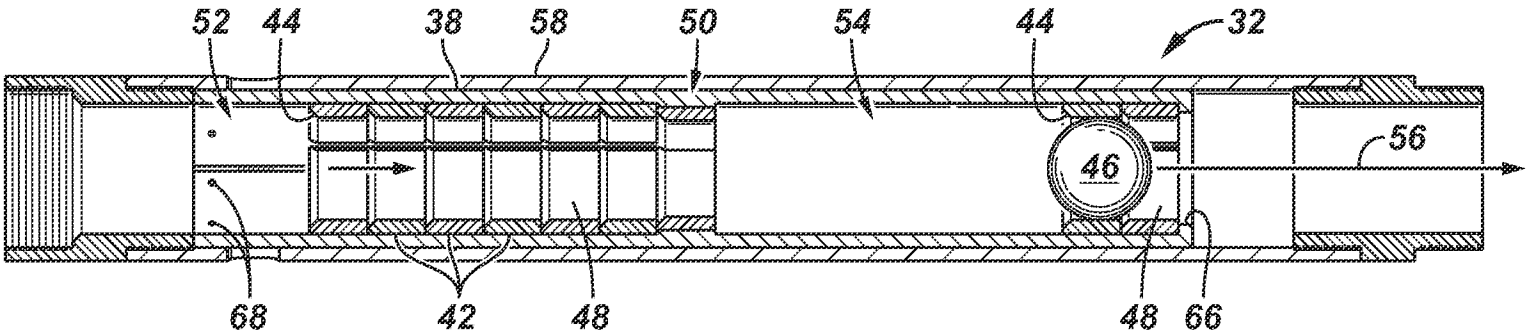
FIG. 3 is a cross-sectional view of the flow control stage illustrated in FIG. 2 but in a different operational position, according to an embodiment of the disclosure.
Figure 4:
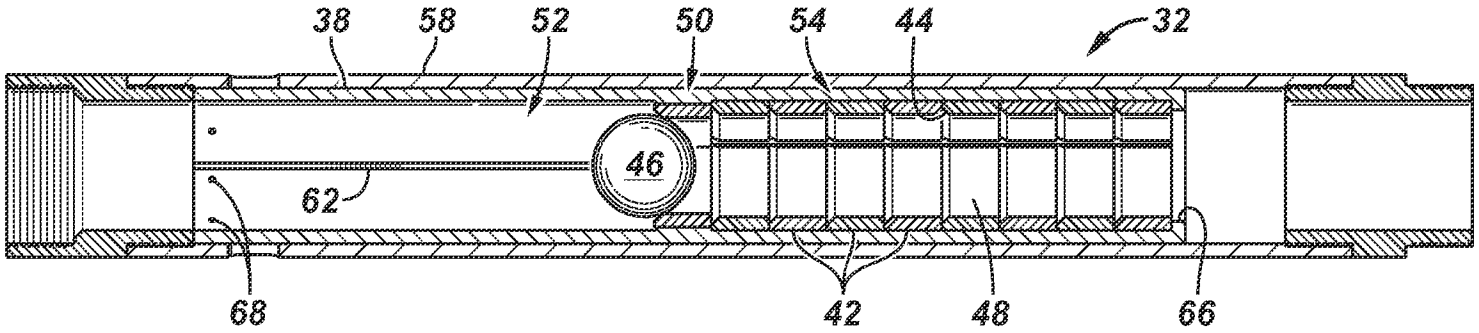
FIG. 4 is a cross-sectional view of the flow control stage illustrated in FIG. 2 but in a different operational position, according to an embodiment of the disclosure.

Each time another ball 46 is moved through the stage 32, a subsequent ball seat 42 is forced past restriction 50 for accumulation within the sliding sleeve 38 at second side 54, as best illustrated in FIG. 3. Once at second side 54, the ball seat 42 once again expands to allow ball 46 to pass through ball seat interiors 48 and on to the next sequential stage 32, as represented by arrow 56 in FIG. 3. Continued passage of balls 46 moves additional ball seats 42 to the second side 54 until the stack of ball seats prevents the ultimate ball seat 42 from moving past the restriction 50, as illustrated in FIG. 4. Consequently, ball 46 also is prevented from passing restriction 50. Continued application of pressure against ball 46 and the ultimate ball seat 42 causes the sliding sleeve 38 to shift and expose flow port 40, as illustrated best in FIG. 5. In the example illustrated, flow port 40 comprises a plurality of flow ports extending radially through a supporting fracturing stage housing 58. The pressurized fracturing fluid is thus forced out through the port 40 and is injected into the corresponding, e.g. surrounding, well zone 34 of the formation.

Figure 6:
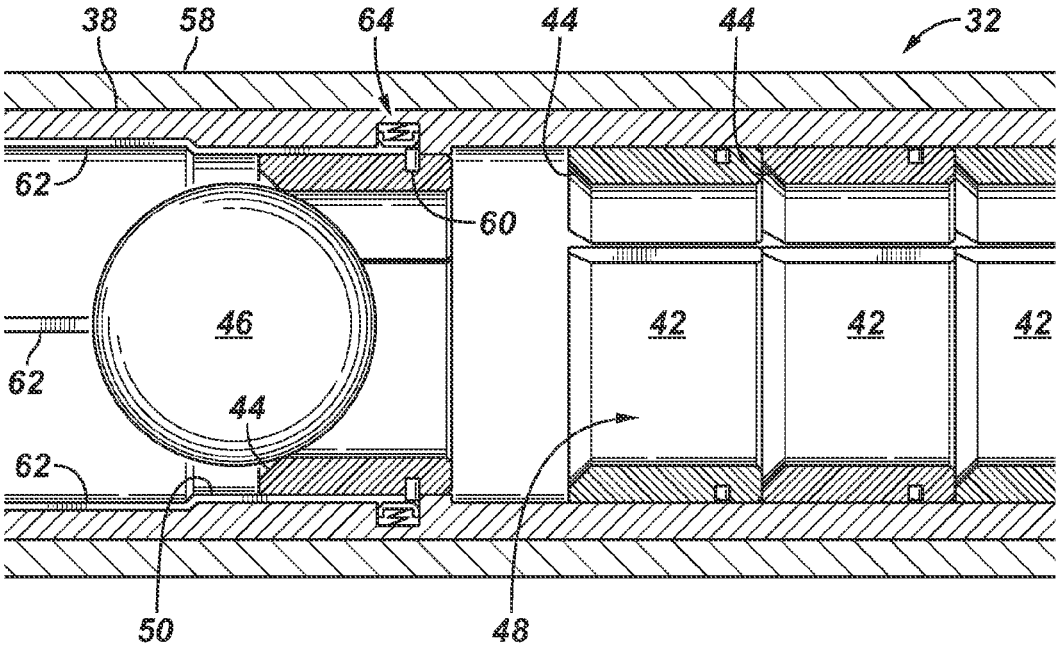
FIG. 6 is an enlarged view of a portion of the flow control stage illustrated in FIG. 5, according to an embodiment of the disclosure.

Referring generally to FIG. 6, an enlarged example of a portion of the fracturing stage 32 is illustrated. In this example, each of the ball seats 42 is engaged with a shear member 60, such as a plurality of shear pins, which extends into cooperation with sliding sleeve 38. As each ball seat 42 moves toward restriction 50, the shear pins 60 (or other suitable shear member) slide along a corresponding slot or slots 62 extending longitudinally along an inner surface of the sliding sleeve 38. The shear member 60 guides the ball seats 42 and prevents relative rotation of the ball seat with respect to sliding sleeve 38 and restriction 50.

If a given ball seat 42 is forced past restriction 50, the shear member 60 is sheared to release the ball seat 42 from restriction 50. However, the ultimate ball seat 42 retained within restriction 50 may remain in engagement with the shear member 60 and sliding sleeve 38 so as to prevent rotation of the ultimate ball seat 42 with respect to the restriction 50 while the ball seat 42 is held within restriction 50. In some applications, each shear member 60 may comprise a spring plunger 64 to help maintain engagement between the ball seat 42 and the surrounding sliding sleeve 38 as the ball seat 42 is transitioned to the radially contracted configuration within restriction 50. Spring plunger 64 also may be used to clear any remaining bits of the shear member after shearing.

In various fracturing operations and other flow control operations, the sleeves 38 are designed to provide a relatively large number or group of fracturing stages 32 that may all be operated with the same size dissolvable ball 46. This enables stimulation of an entire well, or a substantial region of a well, without employing additional ball seat clean out operations. When the ball seats 42 reside in either first side 52 or second side 54 of sleeve 38, the ball seats 42 expand to the radially expanded position which allows balls 46 to pass along the interior 48 of the expanded ball seats 42. The restriction 50 may be in the form of a reduced inside diameter which forces the ball seats 42 to collapse and catch the ball 46. Increased pressure applied down through well string 22 via fluid shears the shear member 60 and allows the ball seat 42 and ball 46 to travel downhole to the larger diameter of second side 54. The ball seat 42 continues to travel through second side 54 until stopping against a shoulder 66 (see FIG. 5) or against the previously stacked ball seats 42.

Figure 5:
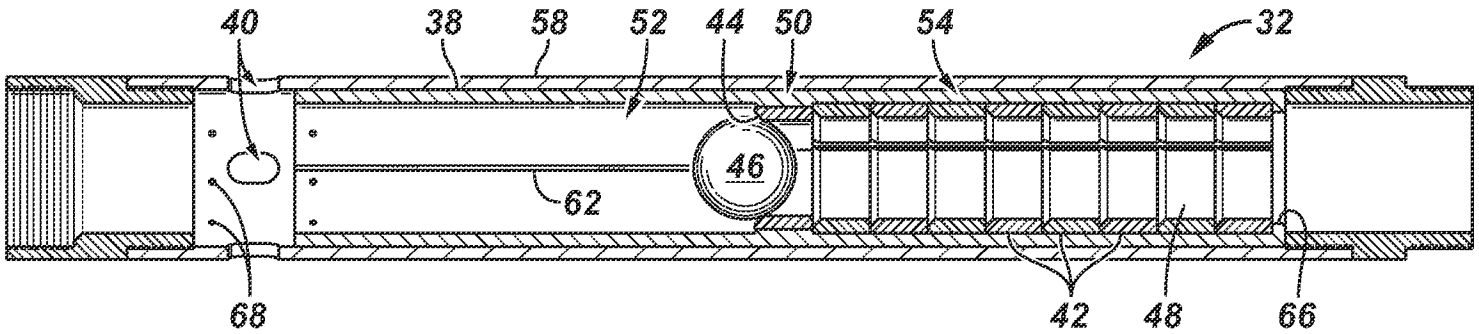
FIG. 5 is a cross-sectional view of the flow control stage illustrated in FIG. 2 but in a different operational position, according to an embodiment of the disclosure.

When a given ball seat 42 is moved past restriction 50 and into second side 54, the next sequential ball seat 42 is moved into the reduced inside diameter of restriction 50 and is stopped when the shear member 60 seats against the end of the slot or slots 62. The spring plunger 64 may be used to remove any remaining portions of the shear member or members after movement of the previous ball seat 42 past restriction 50. Next, a similarly sized ball 46 is dropped and lands on the newly created seat 44 of the ball seat 42 positioned within restriction 50. The pressure again increases until the shear member 60 is sheared and the ball seat 42 and ball 46 are again released. This process is repeated, and the ball seats 42 are stacked up in second side 54 until the ultimate ball seat 42 shoulders out on the stack of ball seats 42 on second side 54, as illustrated in FIGS. 4-6. The increased pressure applied by the fluid in well string 22, e.g. fracturing fluid, is then able to transfer the force to the sliding sleeve 38 and to move the sliding sleeve 38 to a position opening port 40. Fluid, e.g. fracturing fluid, may then be distributed through port 40 to the corresponding well zone 34. It should be noted that in some applications, the sliding sleeve 38 may initially be held in a closed position by a shear member 68, e.g. shear pins, which are sheared upon buildup of pressure against the ultimate ball seat 42 and corresponding ball 46.

Figure 7:
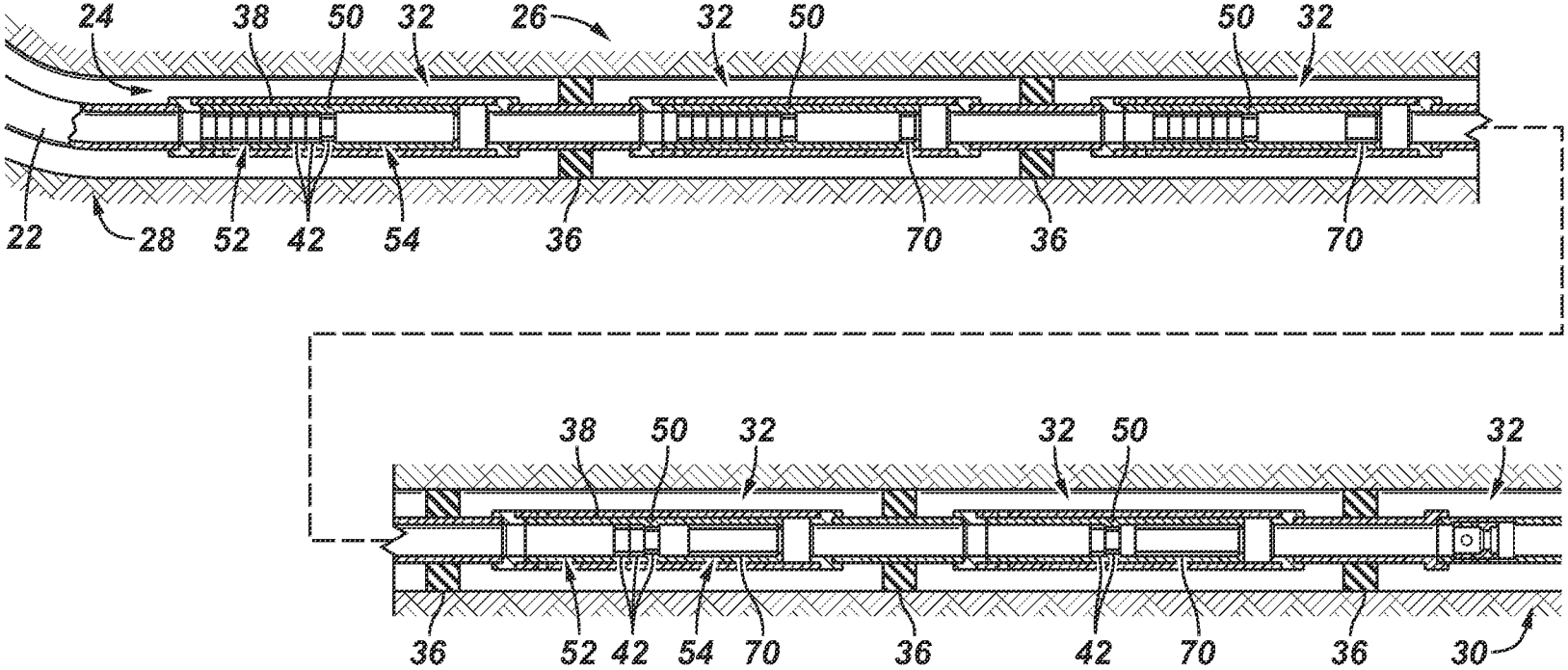
FIG. 7 is a schematic illustration of an example of a flow control system having a plurality of flow control stages arranged in a deviated wellbore, according to an embodiment of the disclosure.

Referring generally to FIG. 7, an example of a system 20 is illustrated as comprising a plurality of fracturing stages 32. In this example, the fracturing stages 32 are actuated to enable injection of fracturing fluid into the corresponding well zone 34 in sequential order beginning with the fracturing stage 32 at the toe 30 of deviated wellbore 26. The first fracturing stage 32 at toe 30 is actuated to an open flow position by dropping the first ball 46 through the preceding/uphole stages 32. As the first ball 46 passes through the plurality of fracturing stages 32, an individual stackable member 42, e.g. ball seat, is moved through the restriction 50 into the second side region 54 of each fracturing stage. The first ball 46 seats in the initial fracturing stage 32 at toe 30 to enable actuation of the corresponding valve/sliding sleeve for fracturing of the corresponding well zone 34. The second ball 46, of a similar diameter, passes through each of the fracturing stages 32 and moves a second stackable member/ball seat 42 through the restriction 50 of each fracturing stage 32 until reaching the penultimate fracturing stage 32.

Figure 8:
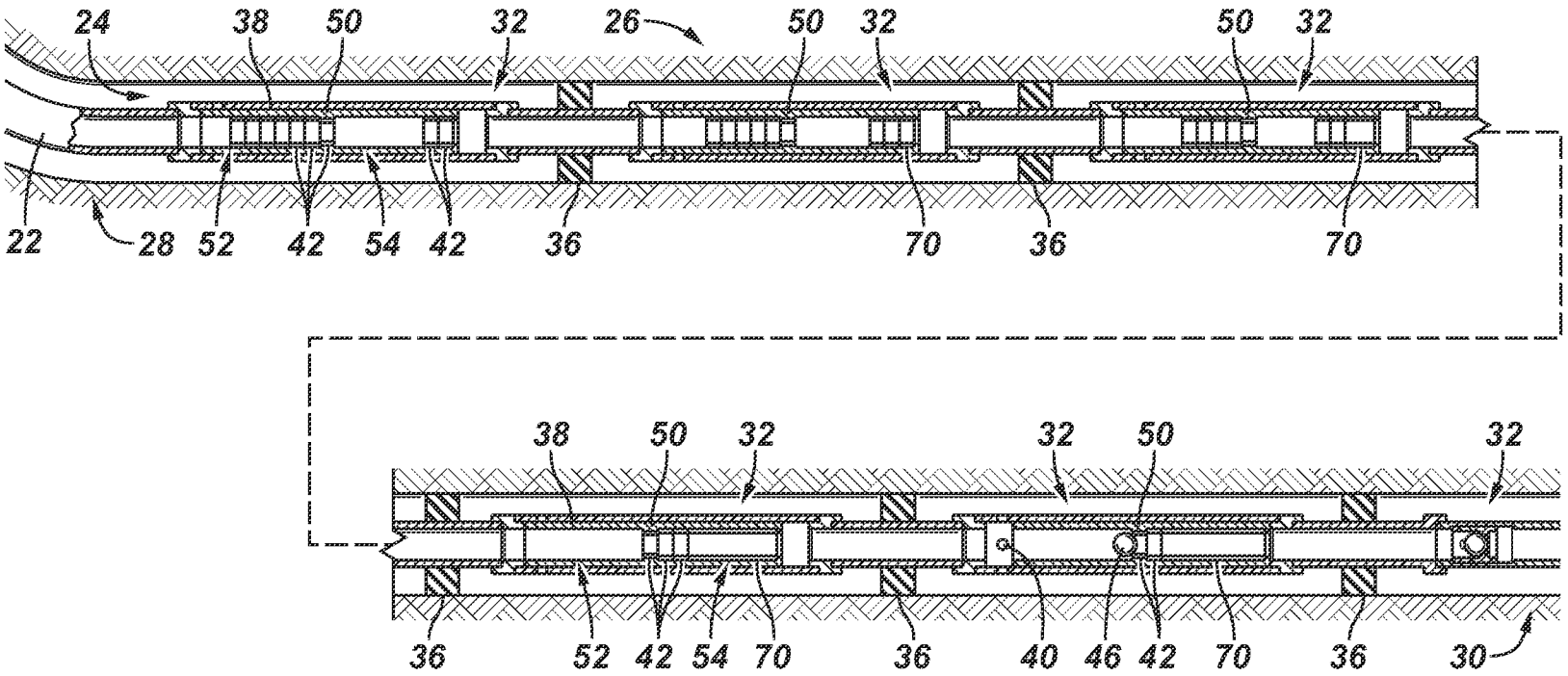
FIG. 8 is a schematic illustration similar to the flow control system illustrated in FIG. 7 but in a different operational configuration, according to an embodiment of the disclosure.

At the penultimate fracturing stage 32, the second stackable member/ball seat 42 is prevented from passing through the restriction 50. Consequently, the ball seat 42 is held in its radially contracted position and blocks passage of ball 46, as illustrated in FIG. 8. The pressure of the fracturing fluid is then used to shift the sliding sleeve 38 and to expose flow port 40, as further illustrated in FIG. 8. This process may be repeated to sequentially actuate each subsequent fracturing stage 32 until reaching the last stage to be actuated, e.g. the fracturing stage 32 proximate heel 28.

In the example illustrated, each sequential fracturing stage 32 comprises an increased number of stackable members/ball seats 42 which enables the sequential opening of flow ports 40 in each sequential fracturing stage 32 moving from, for example, the toe 30 toward the heel 28. By way of example, a plurality of the sequential fracturing stages 32 may each comprise a single additional ball seat 42 relative to the preceding fracturing stage when moving in a direction from the toe 30 toward the heel 28. Single size balls 46 may be used to individually actuate the sequential fracturing stages 32. As described in greater detail below, however, the fracturing stages 32 may be divided into groups of fracturing stages in which each group is actuated by balls having a common diameter or size.

Furthermore, if the restriction 50 is located at a common area in each sliding sleeve 38, spacers 70 may be used in cooperation with the stackable members/ball seats 42 in the second side region 54 of each fracturing stage 32. The spacers 70 are sized to hold the appropriate ball seat 42 within restriction 50 when that particular fracturing stage 32 is to be actuated to an open flow position. As illustrated, each sequential spacer 70 is shorter by the axial length of a single ball seat 42 so as to place the ultimate ball seat 42 within restriction 50 during the appropriate cycle for opening that fracturing stage and releasing fracturing fluid into the corresponding well zone 34 of the surrounding formation. In this example, the first fracturing stage 32 and the last fracturing stage 32 in a given group of fracturing stages 32 may be constructed without spacers 70.

Figure 9:
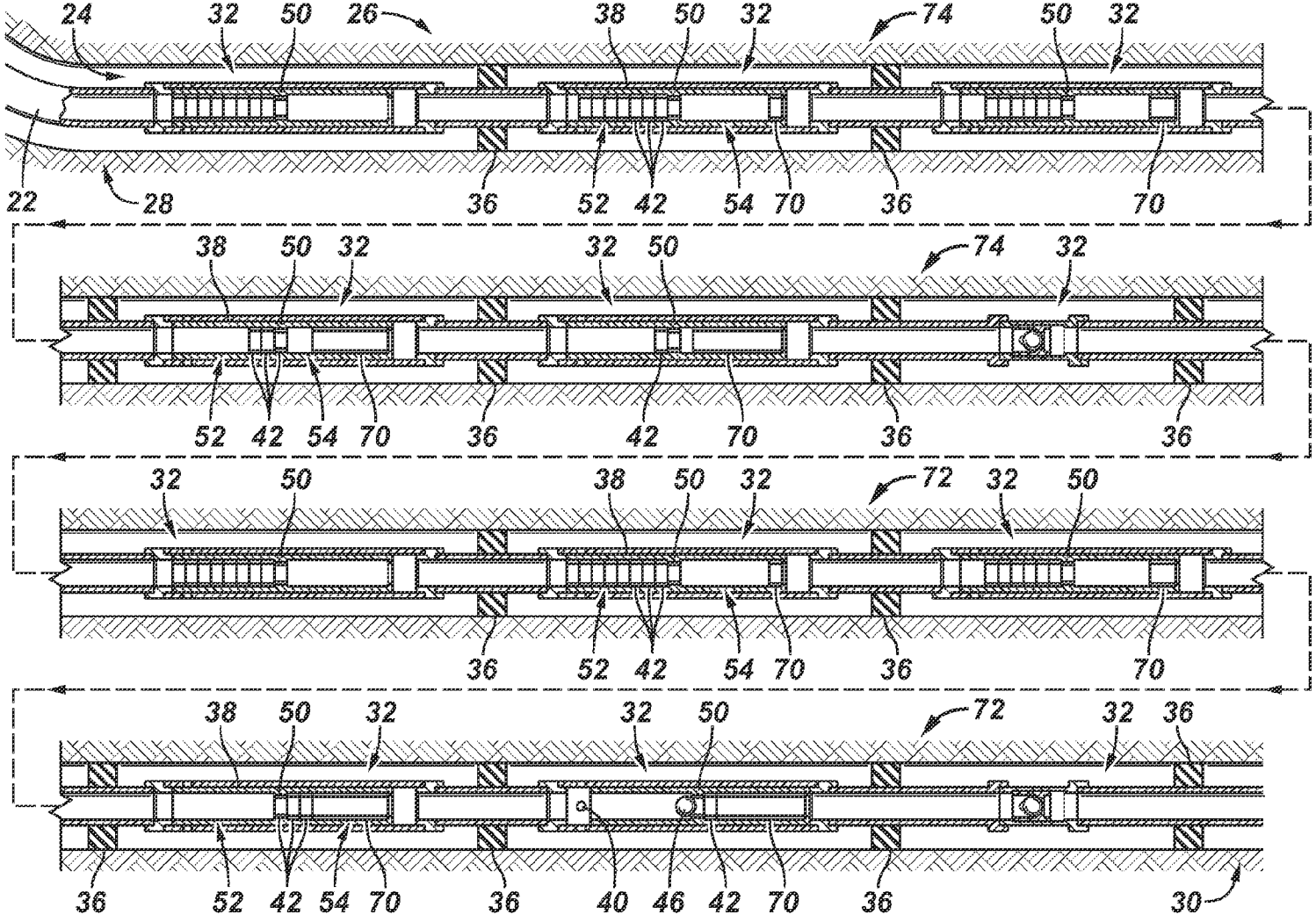
FIG. 9 is a schematic illustration of another example of a flow control system having a plurality of flow control stages arranged in a deviated wellbore, according to an embodiment of the disclosure.

Referring generally to FIG. 9, another embodiment of the system 20 is illustrated. In this example, the stages 32 similarly comprise fracturing stages designed to control the flow of fracturing fluid injected into corresponding well zones 34. In this example, the fracturing stages 32 are actuated to enable injection of fracturing fluid into the corresponding well zones 34 in sequential order beginning with the fracturing stage 32 at the toe 30 of deviated wellbore 26. However, the overall number of fracturing stages 32 is divided into a plurality of groups of fracturing stages 32, such as a first group 72 operated by a common, smaller diameter ball 46 and a second group 74 operated by a common, larger diameter ball 46. It should be noted the overall number of stages 32 may be divided into additional groups of stages in which each group of stages is operated by a specific ball type, e.g. a specifically sized ball. In this type of application, the smaller sized balls 46 are initially used to sequentially actuate the fracturing stages 32 for the first group 72, according to the methodology described above. Subsequently, larger sized balls 46 are used to sequentially actuate the fracturing stages 32 for the second group 74, according to the methodology described above. This process also may be repeated for additional groups of fracturing stages 32. It should further be noted that FIG. 7-9 illustrate a portion of the fracturing stages 32 in the overall sequence of fracturing stages 32 due to the overall length of the fracturing system embodiment.

The construction of system 20 may vary substantially according to the parameters of a given operation, and the sequential flow control may be used in fracturing operations, other well operations, and non-well operations in which fluid flow is sequentially controlled with respect to a plurality of corresponding zones. Additionally, the outflow of fluid through port 40 may be controlled by sliding sleeves or a variety of other valve types, including ball valves, piston controlled valves, and other suitable valve types. Sleeve 38 also may be constructed in a variety of actuator forms suitable for actuating a given valve type. Similarly, the ball seats 42 may be designed in a variety of shapes and configurations. In some examples, the ultimate ball seat 42 comprises seat 44 which forms a sealing engagement with ball 46, while the earlier shifted ball seats are simply stackable members which serve to fill the length of second side region 54 until the ultimate ball seat 42 is received in restriction 50.

Many types of balls 46 also may be used to selectively actuate stages 32. For example, spherical balls, partially spherical balls, darts, cylinders, plugs, and other suitable balls may be used to both shift stackable members/ball seats through the restriction while also engaging the ultimate ball seat in a manner which enables shifting of the stage to an open flow configuration. The balls 46 also may be made from a variety of dissolvable materials or otherwise frangible materials which allow the ball to be broken down into smaller pieces for removal from the stage upon completion of the fracturing or other flow control operation. The number and arrangement of stages also may vary greatly from one application to another. In some fracturing operations, for example, 30, 50, 75, or even 100 or more stages may be utilized to facilitate fracturing in numerous well zones.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for fracturing, comprising:

a well string having a plurality of fracturing stages positioned sequentially along a plurality of corresponding well zones, each fracturing stage comprising:

a sliding sleeve movable to expose an outlet port through which fracturing fluid may be injected into a corresponding well zone;

at least one ball seat compressible between a radially expanded position and a radially contracted position within the sliding sleeve, the radially contracted position blocking passage of a ball used to actuate the sliding sleeve; and a restriction positioned within the sliding sleeve, the restriction being sized to compress the at least one ball seat to the radially contracted position when the at least one ball seat is forced into the restriction;

the number of ball seats changing in sequential fracturing stages of the plurality of fracturing stages in a manner which enables capture of an ultimate ball seat in the restriction when it is desired to open the outlet port of a specific fracturing stage.

2. The system as recited in claim 1, wherein the well string is deployed in a deviated wellbore between a heel and a toe of the deviated wellbore.

3. The system as recited in claim 2, wherein each sequential fracturing stage moving from the toe toward the heel has a larger number of ball seats than the previous fracturing stage for a given group of fracturing stages.

4. The system as recited in claim 3, wherein the number of ball seats increases by one for each sequential fracturing stage in the given group of fracturing stages.

5. The system as recited in claim 3, wherein the plurality of fracturing stages comprises a plurality of given groups of fracturing stages.

6. The system as recited in claim 5, wherein each group of fracturing stages utilizes balls having a diameter that differs from the diameter of balls utilized by another group of fracturing stages.

7. The system as recited in claim 3, wherein some of the fracturing stages comprise spacers located within the sliding sleeve on an opposite side of the restriction from the side on which the ball seats are initially located.

8. The system as recited in claim 3, wherein the ball is able to pass through the ball seat once the ball seat is forced past the restriction.

9. The system as recited in claim 8, wherein the ball is a dissolvable ball.

10. The system as recited in claim 1, wherein each ball seat comprises a shear member which resists passage of the ball seat through the restriction until sufficient pressure is applied to a ball seated against the ball seat to force the ball seat through the restriction, provided sufficient space remains on a downhole side of the restriction to receive the ball seat.

11. A method for actuating valves sequentially, comprising:

utilizing a ball and a ball seat in each stage of a plurality of stages to enable selective actuation of a valve in each stage and to thus enable a selective outflow of fluid at each stage;

positioning a different number of ball seats in each stage to enable individual control over the valves in different stages;

using balls under pressure to force ball seats past a restriction until a sufficient number of ball seats become stacked within a given stage to hold an ultimate ball seat at the restriction; and applying pressure against the ball held by the ultimate ball seat at the given stage to actuate the valve.

12. The method as recited in claim 11, further comprising positioning the plurality of stages along a well string in a deviated wellbore.

13. The method as recited in claim 12, further comprising sequentially opening valves in sequential stages of the plurality of stages to direct fracturing fluid to corresponding well zones.

14. The method as recited in claim 12, wherein positioning comprises positioning an increasing number of ball seats in each sequential stage of a group of stages moving from a tow of the wellbore toward a heel of the wellbore.

15. The method as recited in claim 14, further comprising using spacers of decreasing length in sequential stages, moving in a direction from the toe to the heel, to hold the appropriate ultimate ball seat in the restriction of each sequential stage.

16. The method as recited in claim 11, further comprising forming the restriction as a reduced diameter within a sliding sleeve used to actuate the valve.

17. The method as recited in claim 11, further comprising using dissolvable balls to actuate the valves.

18. A system for controlling flow, comprising:

a flow control stage comprising a sleeve having an internal restriction, the sleeve being positioned to interact with a flow port for controlling flow between an interior and exterior of the flow control stage, the flow control stage further comprising a plurality of stackable members disposed initially on a first side of the restriction, each stackable member being radially compressible to enable movement of individual stackable members past the restriction, via a ball, for collection on a second side of the restriction, the individual stackable members accumulating on the second side until a subsequent stackable member is blocked from passing the restriction, thus providing an obstacle to a subsequent ball used to shift the sleeve and to thus open the flow port.

19. The system as recited in claim 18, wherein the flow control stage is a fracturing stage positioned with a plurality of additional fracturing stages in a well string located in a wellbore to facilitate fracturing of a surrounding formation.

20. The system as recited in claim 19, wherein the individual stackable members in each fracturing stage comprise ball seats.

* * * * *